United States Patent [19]

Koechner et al.

[11] Patent Number: 4,591,709

[45] Date of Patent: May 27, 1986

[54] OPTICAL FIBER SECURITY SYSTEM

[76] Inventors: Walter Koechner, 1054 Harriman St., Great Falls, Va. 22066; Rudolf G. Buser, R.D. 1, Box 153, Wall, N.J. 07719

[21] Appl. No.: 562,734

[22] Filed: Dec. 19, 1983

[51] Int. Cl.[4] ..... G08B 13/18

[52] U.S. Cl. ..... 250/221; 250/227; 340/555

[58] Field of Search ..... 250/221, 227, 231 R, 250/231 P; 340/552, 555, 556, 557, 565, 567; 350/96.15, 96.20, 96.29; 356/32, 35.5, 365

[56] References Cited

U.S. PATENT DOCUMENTS 4,281,245 7/1981 Brogardh et al. ..... 250/227
4,420,251 12/1983 James et al. ..... 356/32
4,477,723 10/1984 Carome et al. ..... 250/227

*Primary Examiner*—Edward P. Westin
*Attorney, Agent, or Firm*—Herman J. Hohauser

[57] ABSTRACT

An optical fiber security system having two optical fiber strands each with a light transmission and detection capability such that a deformation as is caused by unwanted intrusion of one of the strands with respect to the other is detected.

8 Claims, 4 Drawing Figures

OPTICAL FIBER SECURITY SYSTEM

BACKGROUND OF THE INVENTION

1. Field of the Invention

The invention relates to physical security systems utilizing a pressure sensitive optical fiber transducer system wherein the arrangement of optical fibers is combined with signal processing capabilities.

2. Description of the Prior Art

Physical security systems utilizing fiber optics are well known in the prior art and can be broken down into two designations, namely, point sensors and line sensors. A point sensor system can be described as one having a device which measures a disturbance at one point or several discrete points and transmits signals via an optical fiber to a control room or alarm system. In such a system a disturbance at certain discrete points is sensed by means of electrical or optical switches and the like. The optical fiber is used merely to transmit evidence of the disturbance to a detector device. A line sensor system is one in which a disturbance can be detected anywhere along the whole length of the fiber wherein the fiber itself is the sensing element.

U.S. Pat. No. 4,275,296 to Adolfsson, U.S. Pat. No. 4,379,289 to Peek, U.S. Pat. No. 4,281,245 to Brogardh et al. and U.S. Pat. No. 4,367,460 to Hodard are examples of point sensor systems employing optical switches. These types of security systems are not suitable for perimeter or large area protection because of the large number of individual transducers and/or switches that are necessarily required therefor.

The line sensor systems used in above ground applications are exemplified by U.S. Pat. No. 4,275,294 to Davidson and U.S. Pat. No. 4,370,020 to Davey wherein the optical fibers are strung out so that breakage or severe distortion anywhere along the length of the fiber by an intruder will be detected.

Obvious disadvantages of these type systems include visibility of the fibers to an intruder, destruction of the fiber when an intrusion results and exposure to extraneous elements such as weather and the like. Line sensor systems utilizing underground installation of a fiber optic cable as evidenced by U.S. Pat. No. 4,321,463 to Stecher and U.S. Pat. No. 4,297,684 to Butter overcome the above noted disadvantages of the above the ground type. Such systems are generally constructed with the sensing changes in the phase measurements of the light transmitted in the optical fiber and as a result are extremely costly, inflexible in terms of actual installation and subject to a high likelihood of a false alarm.

No known prior art physical security system measures changes in the intensity of light transmitted through fiber optic strands. The only technology known to applicants related to measurement of change in intensity of light in fiber optic strands is embodied in the teachings of U.S. Pat. No. 4,342,907 to Macedo et al. In that patent it is noted that a cladded optical fiber subjected to pressure has inherent therein a change of the refractive index in the cladding material. The change of the refractive index results in a change in the light being transmitted in the optical fiber strand because light is allowed to escape from the fiber core.

Heretofore no one has been able to utilize the principle taught in the Macedo et al patent in a physical security system.

SUMMARY OF THE INVENTION

The present invention is directed to a line sensor type optical fiber physical security system that overcomes the above noted disadvantages of the prior art. The inventive system utilizes optical fiber strands as pressure sensitive transducers, a photo optic transmitter, a photo optic receiver, a signal processing unit and an external response system in a unique combination that results in a relatively simple, trouble free physical security system.

In the preferred embodiment two fiber optic loops are provided each loop having a light emitting diode (LED) transmitter connected to one end and a photodiode receiver on the other end.

The LED transmitters are activated by a current stabilized pulse generator. The radiation received by each photodiode receiver is directed to a differential amplifier through a transimpedance amplifier. The two fiber waveguides are optically and electrically arranged so that only changes in one fiber strand with respect to the other are detected. The differential measurement capability results in an extremely high sensitivity concurrent with a high common mode rejection against effects or changes in both fibers. System noise is reduced by the provision of a bandpass filter that is connected to the output of the differential amplifier. If the differential optical signal exceeds a predetermined threshold a signal will be generated by an adjustable threshold detector to trigger a response device such as an alarm or the like.

An automatic signal processing or servo loop operates to maintain the optical fiber loops balanced with respect to each other so as to compensate for long term drifts in conditions such as temperature and the like. Without such a balancing control environmental changes could effect the differential measurement referred to above. As change in temperature occurs, for example, the output of one of the LEDs is adjusted to maintain a balanced system. Transient signal changes are not sensed by the servo control circuit so that a change of condition of one fiber with respect to the other, as occurs when there is an intrusion, can be detected.

In use the optical fiber strands are placed far enough apart from one another so that an intruder will cause a change in one with respect to the other. Either optical fiber strand loop can serve as the pressure sensitive transducer.

DESCRIPTION OF THE PREFERRED EMBODIMENT

Figure 1:
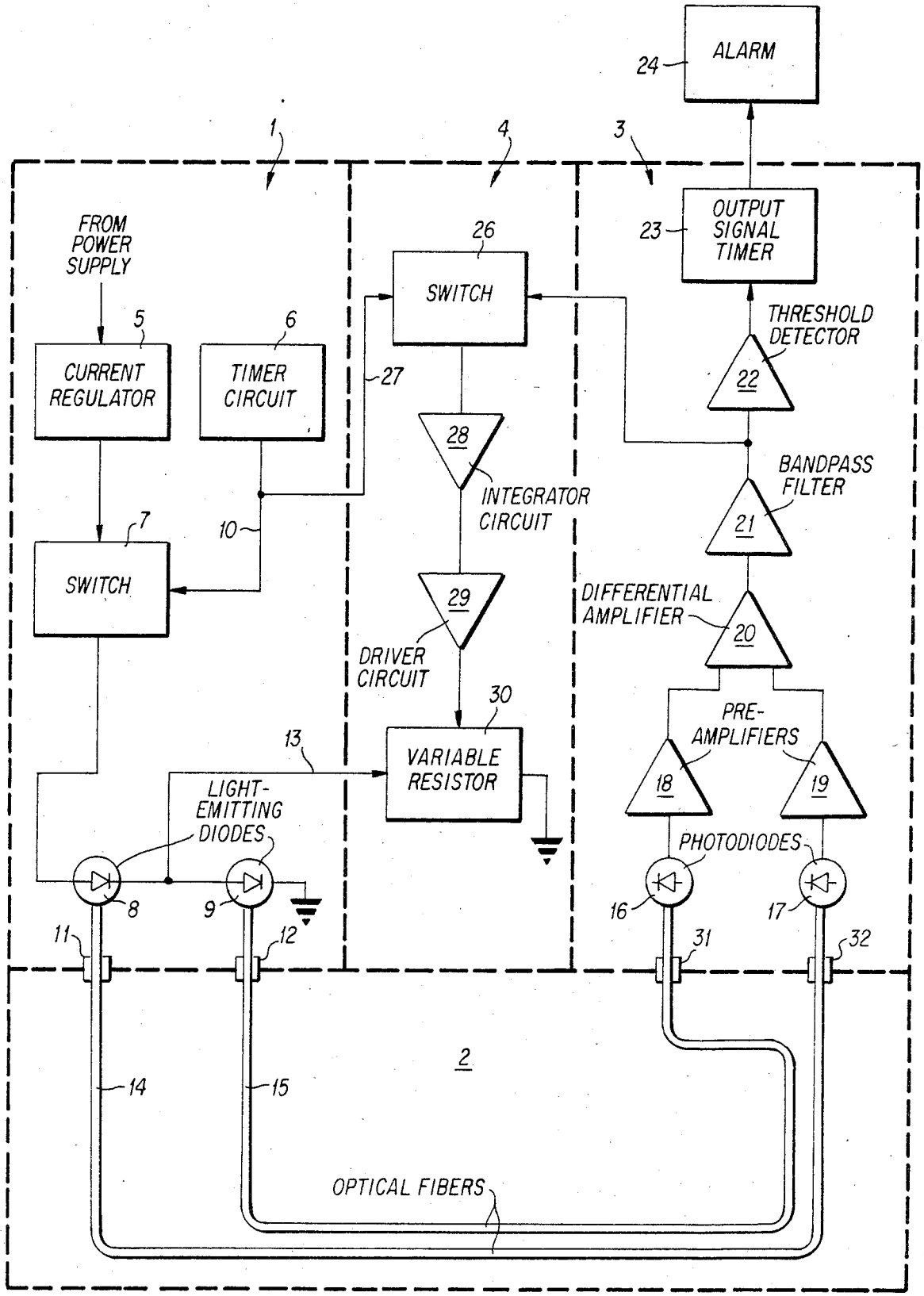
FIG. 1 is a schematic diagram of the inventive system.

In FIG. 1 the intrusion alarm system is depicted in schematic form and is shown to consist of transmitter subsystem 1, pair of optical fiber transducers referred to generally as 2, receiver section 3, servo control subsystem 4 and various alarm devices generally referred to as 24. As will be explained in greater detail below transmitter subsystem 1 consists of current regulator 5, timer circuit shown as 6 and switch 7 and light emitting diodes (LED) 8 and 9. Current regulator 5, timer circuit 6 and switch 7 are generally referred to as the current pulse generator. Receiver section 3 is seen to consist of photodiodes 16 and 17, preamplifiers 18 and 19, differential amplifier 20, bandpass filter 21, threshold detector 22 and output signal timer 23. Servo control subsystem 4 includes switch 26, integrator circuit generally designated as 28, driver circuit 29 and variable resistor 30.

Optical fibers 14 and 15 may be a low-loss silicone polymer clad glass core fiber, such as Fiber Industries type Superguide B. However, the invention is not dependent on a specific type of fiber. Optical fibers ranging from 200 μm to 1000 μm core diameter and polymer clad glass fibers as well as all plastic fibers have been tested and found equally well suited for this application. In the preferred embodiment fibers 14 and 15 are either buried underground or located underneath floor coverings.

Figure 2:
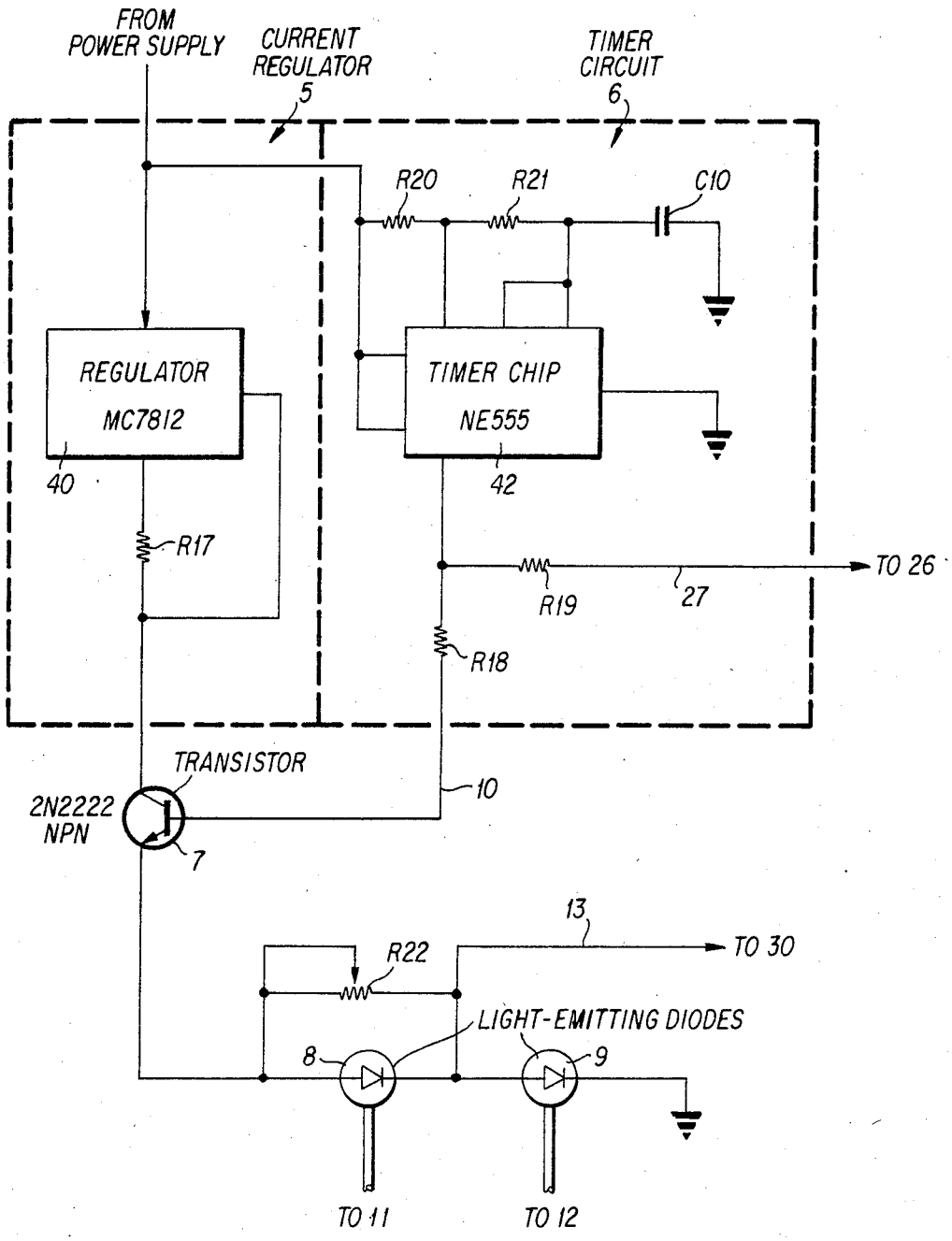
FIG. 2 is a detailed schematic diagram of transmitter subsystem.

Referring to FIG. 2 transmitter subsystem 1 is seen in greater detail. Current regulator 5 consists of integrated circuit chip 40 and resistor R17. In the preferred embodiment integrated circuit chip 40 is a three terminal integrated circuit regulator commercially available from Motorola under the designation MC7812. Timer circuit 6 includes integrated circuit timer chip 42 for generating accurate time delays or oscillations. In the preferred embodiment an eight terminal chip is used that is commercially available from Signetics under the designation NE555. Switch 7 is a general purpose npn transistor which in the preferred embodiment is commercially available under the designation 2N222.

Timing circuit 6 generates voltage pulses which are connected to the base of the on-off transistor switch 7. When there is no pulse from timing circuit 6 transistor 7 is in an open or "off" condition. Upon the occurrance of a 2 millisecond pulse from timing circuit 6 transistor 7 is closed or in an "on" condition so that current is passed from current regulator 5 to both LEDs 8 and 9. The current pulse through LEDs 8 and 9 results in optical radiation being generated for transmission through optical fiber strands 14 and 15 via connectors 11 and 12 respectively. The pulse duration and pulse interval is determined by the values of the resistors R20 and R21 and capacitor C10 connected to terminals of the timer chip as shown in FIG. 2. In the preferred embodiment a pulse of 2 millisecond duration with a pulse interval of 2 millisecond duration is achieved (using values designated in the drawings). As will be explained in more detail below potentiometer R22 is connected in parallel with LED 8 to provide a coarse adjustment in the intensity of the light transmitted in fiber optic strand 14. The light emitting diodes described above may be Honeywell Fiber Optic LED type SE4352-003.

Figure 3:
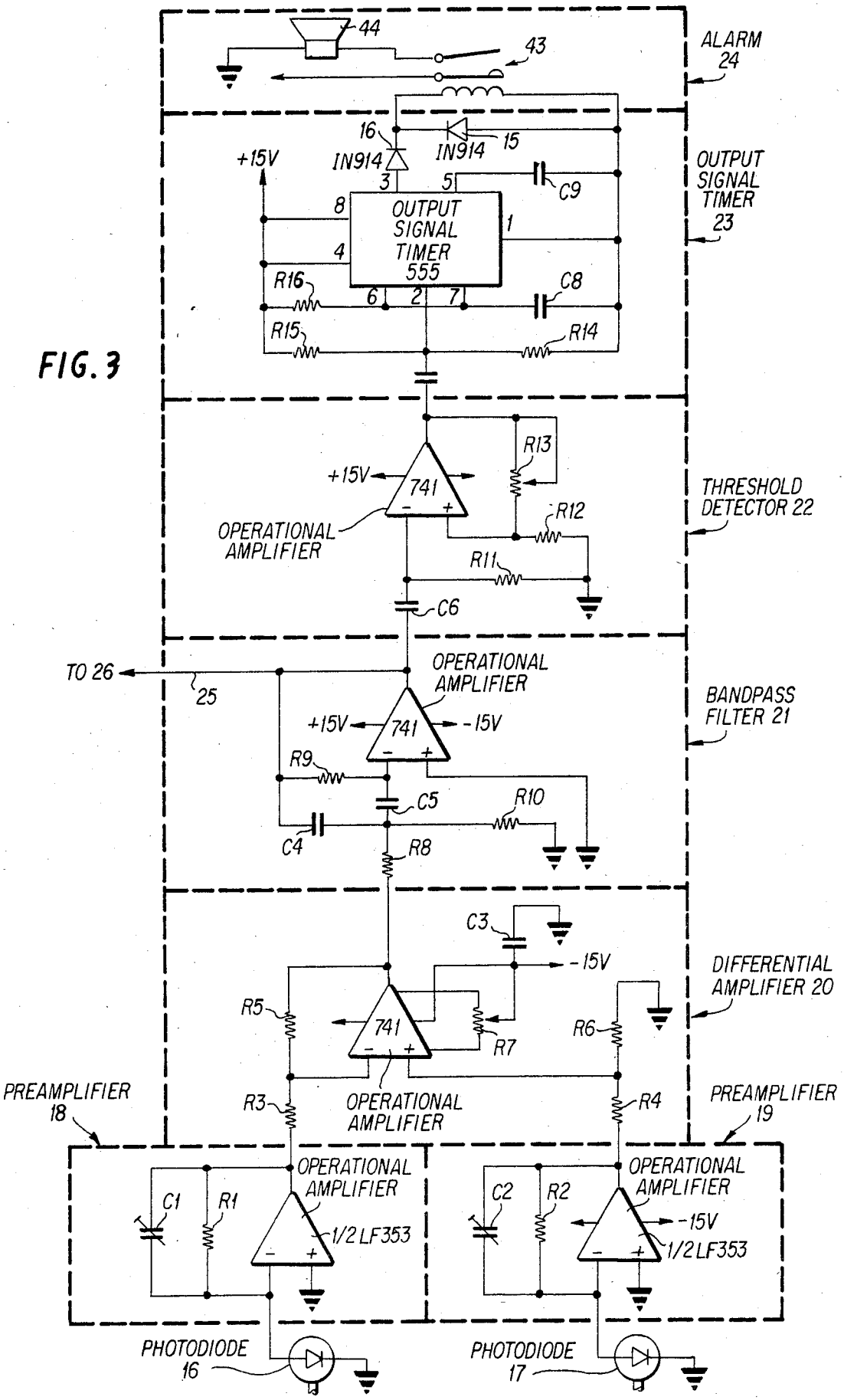
FIG. 3 is a detailed schematic diagram of the receiver subsystem.

Receiver section 3 is shown in schematic detail in FIG. 3 wherein it is seen that the ends of fiber optic strands 14 and 15 are connected to photodiodes 16 and 17 via the connectors 31 and 32 respectively. The photodiodes may be Honeywell fiber optic detectors, PIN diodes type SD 3478-002. The anodes of the photodiodes operated in the photovoltaic mode are connected to the input leads of two operational amplifiers 18 and 19. The two operational amplifiers are actually contained in a single package to minimize temperature drift. The device including the two operational amplifiers is commercially available as integrated circuit "Operational Amplifier Model LF 353" from National Semiconductors. This particular device uses field effect transistor technology to provide a high impedance input combined with low noise. The current generated by the photodiode as a result of incident light on the fiber strands creates a voltage across resistors R1 and R2, respectively. Both preamplifiers are identical with regard to the arrangement and value of the components. The small adjustable capacitances in parallel to the resistors R1 and R2 is to reduce the bandwidth of the amplifiers and thus eliminate high frequency noise.

The output from the two preamplifiers 18 and 19 is connected to a differential amplifier via resistors R3 and R4. The inverse polarity input is connected to the output by means of resistor R5, whereas the normal polarity input is connected to ground with a resistor R6. This is the circuit of a conventional differential amplifier. The gain of this amplifier is controlled by the ratio of resistors R5, R6 to resistors R3, R4. The integrated circuit selected may be an operational amplifier type MC1741 made by Motorola. Off-set voltage of the differential amplifier is reduced to zero by the potentiometer R7 connected to the off-set adjustment leads of the device. The MC1741 device is operated from a ±15 V powersupply. Capacitor C3 will filter noise from the powersupply. The purpose of the differential amplifier 20 is to amplify any voltage difference between the output from preamplifiers 18 and 19.

The output from the preamplifier is connected to a bandpass filter 21. The appropriate combination of three resistors R8, R9, R10, and two capacitors C4, C5 will provide a narrow bandpass characteristic. For example, in the preferred embodiment the active filter has a center frequency of 250 Hz and a bandwidth of ±25 Hz at the 3 dB points (Q=10). Only the sinosoidal first harmonic of the signal generated by the transmitter subsystem 1 is passed by this filter. In this way any extraneous noise introduced by the photodiodes 16, 17, preamplifiers 18, 19, and differential amplifier 20 is eliminated.

The output from the bandpass filter is connected to a threshold detector 22. The combination of capacitor C6 and resistor R11 at the input provides for ac coupling. The resistive network comprised of potentiometer R13 and resistor R12 allows adjustment of the threshold at which the device is triggered. Typically the potentiometer is adjusted for a threshold level of 50 millivolts. If the input exceeds this level a large 10 V signal appears at the output of the threshold detector. Either a positive or negative signal exceeding the 50 millivolt level will cause a 10 V signal output. The active bandpass filter may use operational amplifier MC1741 from Motorola.

The output of the threshold detector 22 is connected to an output signal timer 23. This device provides an output signal of fixed duration every time the threshold device generates an output signal. The combination of circuit components and timer chip NE555 made by Signetics comprises a monostable multivibrator. The two resistors R13, R14 and capacitor C7 provide ac coupling of the signal into the timer circuit and proper bias voltage for operation of the NE555.

The duration of the output signal is determined by resistor R17 and capacitor C8. These values may be chosen to provide an output signal of 10 seconds. Small resistor and capacitor values will provide shorter output signals; conversely large values can increase output signals to minutes if desired. The output signal lasting for 10 seconds activates a relay for this duration. Any external alarm indicator such as a loudspeaker, buzzer, bell, light, tape-recorder, etc., can be turned on by the closure of the relay contacts. As an example, FIG. 3 shows the activation of a buzzer 44 by relay 43. Upon closure of relay contacts the buzzer 44 is connected to a 15 V powersource. The two diodes IN914 protect the integrated circuit chip NE555 from voltage spikes which may be generated by the coil of relay 43.

Figure 4:
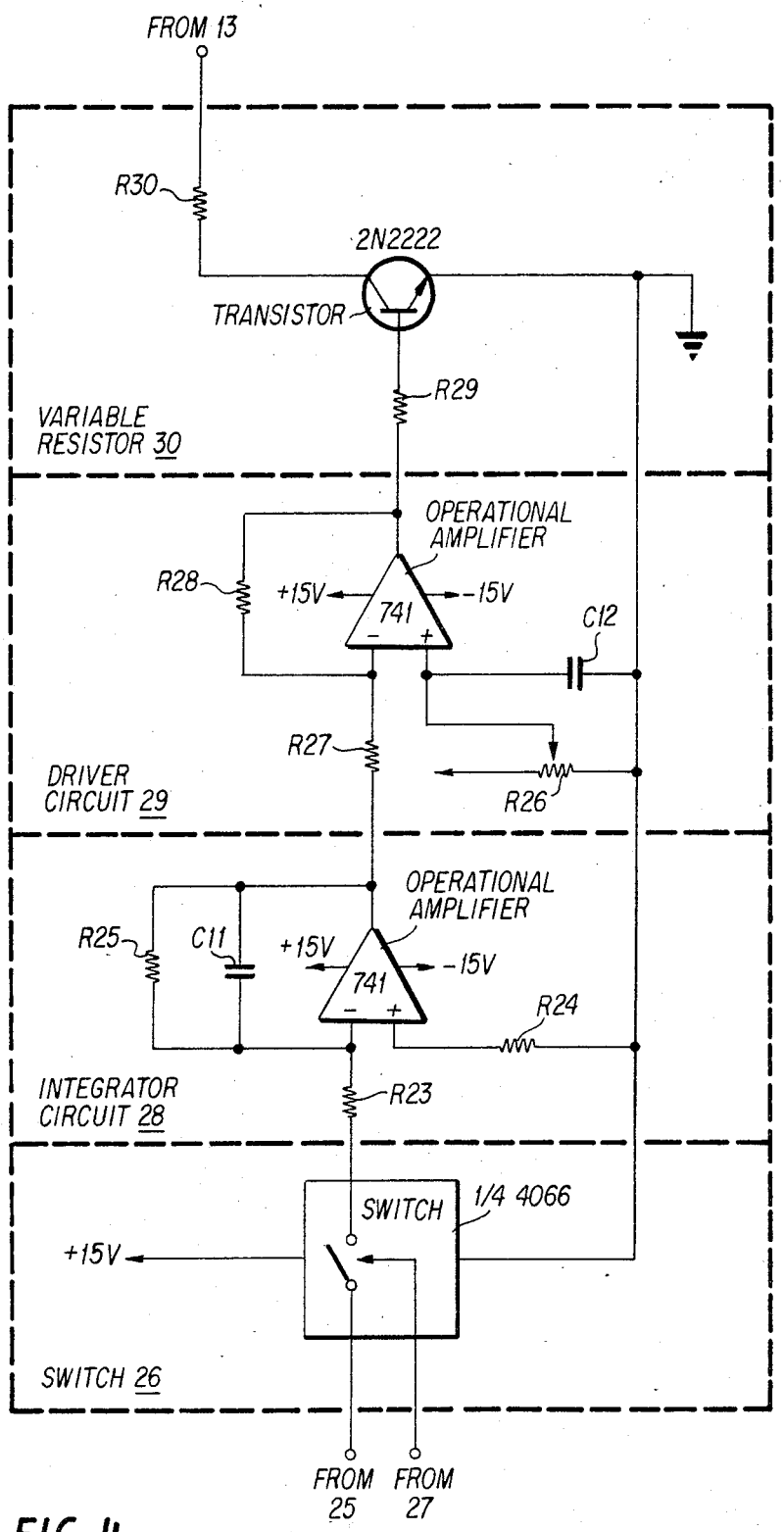
FIG. 4 is a detailed schematic diagram of the automatic signal processing subsystem.

FIG. 4 shows details of the servo control subsystem 4. Its purpose as stated earlier is to maintain the light input to the preamplifiers balanced without affecting the transient response obtained from an intrusion signal.

The first element of the servo control system 4 is switch 26. The switch may be a CM05 gate Model CD4066 made by RCA. The switch 26 connects the output of bandpass filter 21 via 25 with the input of the integrator circuit 28. The switch 26 is normally open and closes only after a signal is received via line 27 from timer transmitter circuit 42 shown in FIG. 2. If the switch is closed any voltage at input 25 which stems from a signal at the output of the bandpass filter 21 charges capacitor C11 of the integrator 28.

The integrator 28 is comprised of an operational amplifier MC1741, an integrating capacitor C1, reset resistor R25 and resistors R23, R24. A voltage at the input of the integrator 28 will charge capacitor C11. The reset resistor R25 will slowly discharge capacitor C11. Resistors R23 and R24 provide the appropriate input levels.

A small voltage present at input 25 of the switch will be sensed each time the transmitter is pulsed and will cause a slowly rising voltage on the capacitor. The build-up time is determined by resistor R23 and capacitor C11. The risetime may be 10 seconds. Small voltage differences occuring at each pulse are integrated and provide a constant voltage at the capacitor.

The driver circuit 29 is an amplifier which brings the voltage to the appropriate level to drive transistor 30. The gain of this amplifier is determined by resistors R27 and R28. The output dc level is controlled by potentiometer R26. The capacitor C12 removes noise from the line. The dc output of amplifier 29 is set such that the transistor has an emitter-collector current of about 5 mA. The collector of transistor 2N2222 is connected to LED 9 via line 13 shown in FIGS. 1 and 2. The transistor circuit 30 is actually performing as a variable resistor connected in parallel to LED 9. As mentioned before, a current of about 5 mA is bypassed from the LED by this transistor. Depending on the voltage received from the integrator 28 and driver 29 the voltage of the base of transistor 30 changes up or down, thus increasing or decreasing the current flow through resistor R30. If the current through the transistor increases the current through the LED 9 will decrease and the radiation output from this light emitting diode will decrease, and vice versa.

In operation, light pulses are generated by the light emitting diodes 8 and 9 as a result of electric current pulses generated by timer 6 and switch 7, and constant current source 5. The light pulses from diodes 8 and 9 are propagated through optical fibers 14 and 15. Radiation generated by diodes 8 and 9, transmitted via optical fibers 14 and 15 are received by photodiodes 16 and 17. The output from each channel comprised of light emitting diodes 8 or 9, fiber cable 14 or 15, photodetector 17 or 16, and preamplifier 19 or 18, is directed into a common differential amplifier 20. Provided that the light output from LED's 8 and 9 is adjusted properly, both channels can be balanced such that the output of photodetectors 16 and 17 is exactly equal. Therefore, the output of differential amplifier 20 will be zero and the subsequent circuits 21, 22, 23 and 24 will be inoperative.

If a small pressure is exerted anywhere along the length of either fiber 14 or 15 an optical loss will occur at that point and less light will be received at detector 16 or 17. Such pressure can be the result of an intruder stepping on optical fiber 14 or 15 buried in the ground in an outdoor application, or located below a carpet in an indoor application of this invention. The radiation received at detectors 16 and 17 is no longer equal as a result of an optical loss introduced in one of the fibers by an intruder. This signal difference will be greatly amplified by the differential amplifier 20. After passing through the bandfilter 21 the differential voltage is incident on a threshold detector 22. If the signal exceeds a preset threshold the threshold device 22 issues a large voltage signal which triggers a timer circuit which in turn activates alarm devices 44 for a preset amount of time.

By comparing the voltage levels at diodes 16 and 17 and amplifying the differences in amplifier 20 rather than measuring absolute values, a very highly sensitive system can be built. In order to prevent high false alarm rates any noise spikes which may be amplified by the operational amplifier 20 and may trigger the threshold device 22 have to be suppressed. This is achieved with a narrow bandpass filter 21 which transmits only signals generated by the transmitter 1 and thus rejects noise spikes generated by the photodiodes 16, 17, preamplifiers 18, 19 or differential amplifier 20.

Besides noise pulses which might trigger the threshold device, long term drift of one fiber output with respect to another fiber has to be controlled. In practice, temperature differences in the environment where fibers 14 and 15 are placed or temperature differences in the electronics will cause a slow drift of the outputs at 16 and 17. Small differences will be amplified by differential amplifier 20 and these signals will be transmitted by bandfilter 21 and will eventually trigger the threshold device 22.

Slow voltage changes are sampled by the servo control loop 4. Small voltage differences which appear at the output of bandfilter 21 will charge capacitor C11 in the integrator circuit 28. The voltage at this capacitor which appears at the output of integrator 28 is amplified and used to control the current of transistor 2N2222. CED 9 and transistor 2N2222 are electrically connected in parallel. The current in transistor 2N2222 is controlled by the output from the integrator 28. Depending on the polarity of the voltage the current in transistor 2N2222 will either be decreased or increased. since transistor 2N2222 and LED 9 are fed from a constant current source 5, the sum of the current in both devices is constant. Therefore, controlling the current in transistor 2N2222 will adjust the current in LED 9 and thereby adjust the light output in this LED. The amount of control is dependent on the gain of the feedback loop which is determined by integrator 28 and amplifier 29.

We claim:

1. A security system comprising:

a first independently cladded optical fiber strand having a first light source connected to one end thereof and a first light intensity detection means connected to the other end thereof;

a second independently cladded optical fiber strand having second light source connected to one end thereof and a second light intensity detection means connected to the other end thereof;

said first fiber strand being spaced apart and completely unconnected to said second fiber strand, means responsive to a predetermined light intensity loss caused by deformation of either of said first or second fiber strand at any point along the length of said first or second fiber strand when there is no change in the light intensity of the other of said first or second fiber strand to actuate intrusion detection means wherein the light intensity reaching said first light intensity detection means is substantially equal to the light intensity reaching the said second light intensity detection means before a deformation is caused in either the first or second fiber strand and wherein the light intensity detection means are unequal when a deformation occurs in one of said first or second fiber strand.

2. The security system of claim 1 wherein the light intensity in either of said first or second fiber strand is automatically adjusted upon predetermined conditions being sensed by signal processing means.

3. The security system of claim 1 wherein said first light source is a light emitting diode activated by a current stabilized pulse generator.

4. The security system of claim 2 wherein said first light source is a light emitting diode activated by a current stabilized pulse generator.

5. The security system of claim 1 wherein the outputs of said first and second light intensity detection means are compared by differential measuring means, said differential measuring means having an output differential signal for detecting predetermined changes in light intensity loss.

6. The security system of claim 2 wherein the outputs of said first and second light intensity detection means are compared by differential measuring means, said differential measuring means having an output differential signal for detecting predetermined changes in light intensity loss.

7. The security system of claim 3 wherein the outputs of said first and second light intensity detection means are compared by differential measuring means, said differential measuring means having an output differential signal for detecting predetermined changes in light intensity loss.

8. The security system of claim 4 wherein the outputs of said first and second light intensity detection means are compared by differential measuring means, said differential measuring means having an output differential signal for detecting predetermined changes in light intensity loss.

* * * * *